US005626286A

United States Patent [19]

Petkovsek

[11] Patent Number: 5,626,286

[45] Date of Patent: May 6, 1997

[54] ONE-PIECE SPECIAL SERVICE MAILING ASSEMBLY WITH FLAPLESS SEALING AND A METHOD FOR FORMING A UNITARY MAILPIECE

[75] Inventor: Glenn Petkovsek, 20 Tortoise Park Cove, Little Rock, Ark. 72211-2349

[73] Assignee: Glenn Petkovsek, Little Rock, Ark.

[21] Appl. No.: 398,747

[22] Filed: Mar. 6, 1995

[51] Int. Cl.[6] ..... B65D 27/00

[52] U.S. Cl. ..... 229/300; 229/70; 229/92.8; 229/315

[58] Field of Search ..... 229/92.8, 70, 68.1, 229/314, 315, 300

[56] References Cited

U.S. PATENT DOCUMENTS

| | | | |
|---|---|---|---|
| 677,248 | 6/1901 | Meixell | 229/68.1 |
| 1,436,885 | 11/1922 | Leary | 229/70 |
| 1,568,880 | 1/1926 | Conklin | 229/92.8 |
| 2,279,164 | 4/1942 | Gettleman | 229/92.8 |
| 4,429,827 | 2/1984 | Murray | 229/68.1 |
| 4,682,793 | 7/1987 | Walz . | |
| 4,749,124 | 6/1988 | Bazan | 229/92.8 |
| 4,809,905 | 3/1989 | Goodman | 229/70 |
| 4,892,246 | 1/1990 | Norman | 229/92.8 |
| 4,951,864 | 8/1990 | Dicker . | |
| 5,100,179 | 3/1992 | Burden et al. | 229/92.8 |

*Primary Examiner*—Stephen P. Garbe
*Attorney, Agent, or Firm*—Hill, Steadman & Simpson

[57] ABSTRACT

A system for mailing an article requiring special services and a method for forming a mailpiece having an interior for carrying an article requiring special services are provided. The system includes an integrally formed envelope and form constructed from a single sheet folded and sealed in such a way that one portion of the assembly provides an envelope and the other portion provides a return postcard and at least one other form for attachment to the envelope in its assembled position. The parts are integrally formed, but removably attached, such that the return postcard remains attached to the envelope until received by the addressee at which time the return postcard may be removed. Alternatively, the system may be constructed from two sheets appropriately sealed.

18 Claims, 5 Drawing Sheets

ONE-PIECE SPECIAL SERVICE MAILING ASSEMBLY WITH FLAPLESS SEALING AND A METHOD FOR FORMING A UNITARY MAILPIECE

BACKGROUND OF THE INVENTION

The present invention generally relates to a combined envelope and forms for mailing an article requiring special services. More specifically, the present invention relates to a flapless envelope for mailing an article requiring special services having a return receipt postcard and at least one form removably attached to the flapless envelope prior to assembly or formation of the flapless envelope.

It is, of course, generally known to mail an article requiring special services for delivery of the article, such as certified mail, registered mail, insured mail, COD, return receipt for merchandise and the like. Known components and methods for assembling a mailer for mailing an article requiring special services have multiple, separate components requiring attachment to an exterior of an envelope for the special services delivery of the article.

For example, when a customer of the U.S. Postal Service desires that an article be mailed by certified mail, for instance, an envelope containing the article is provided to the postal employee by the customer. The postal employee is then required to attach or otherwise provide the envelope with a permanent seal or label indicating that the envelope is to be delivered by certified mail.

Then, a return receipt postcard must be attached to the envelope. The postcard must be completed by the postal employee and/or the customer mailing the envelope containing the article. Some postcards include areas having an adhesive for attaching the postcard to the envelope. Other postcards require separate attachment, by using tape, for example.

Such a procedure is both complex and time-consuming, as well as labor intensive. The procedure requires the postal employee to ensure that all of the appropriate labels and documents are affixed to the envelope prior to delivery of the article. Therefore, the appropriate forms, labels and the like must be adequately stocked and available for the postal employee's use. Further, the postal employee must ensure that all articles are appropriately affixed to the envelope. In addition, the return receipt postcard must be suitably affixed to the envelope so that the return postcard is not removed during the mailing of the article to its destination. Of course, it should be understood that an envelope prepared for special service mailing may be prepared by any individual, not just a postal employee.

A need, therefore, exists for an improved mailing assembly and a method for mailing a mailpiece requiring special services, such as certified mail, insured mail, registered mail, COD, return receipt for merchandise and the like.

SUMMARY OF THE INVENTION

The present invention provides a system and a method for mailing and forming a mailpiece for mailing an article requiring special services, such as for certified mail, insured mail, register mail, COD, return receipt for merchandise and the like. The system includes a combined mailing assembly formed from a first and a second sheet folded and sealed such that a portion of the sheets provides an envelope having an interior compartment and the other portion of the sheets provides a return postcard and appropriate sealing sections.

To this end, in an embodiment of the present invention, a system is provided for mailing an article requiring special services. The system comprises a flapless envelope having an interior compartment formed by a first sheet and a second sheet, a first portion of the sheets sealed along three sides of the first portion to form the interior compartment and a second portion of the sheets extending beyond one of the sealed sides of the first portion wherein the second portion is sealed to form a return postcard and at least one form wherein the return postcard and the at least one form are integrally formed with the flapless envelope and are independently detachable from the flapless envelope.

In an embodiment, the system includes at least one form that is a delivery notice/receipt form integrally formed with the sheets forming the flapless envelope and wherein the delivery notice/receipt form is individually, selectively detachable from the envelope.

In an embodiment, the system comprises a perforated tear line in the second portion constructed and arranged to provide independent removal of the return postcard or the at least one form.

In an embodiment, the system comprises a perforated tear line formed between the return postcard and the at least one form. The perforated tear line is constructed and arranged to provide independent removal of the return postcard and the at least one form.

In an embodiment, the system comprises a removable section adjacent the width of the first and the second portions of the sheets.

In an embodiment, the system further comprises at least one identifier section having an identifier related to the article requiring special services removably attached to the first portion of the sheets.

In an embodiment, the system comprises a designator on the flapless envelope indicative of the special service required.

In another embodiment of the present invention, a method is provided for forming a unitary mailpiece having an interior compartment for carrying an article requiring special services. The method comprises the steps of: providing a flapless envelope for carrying the article requiring special services; providing at least one form integrally formed with the flapless envelope; and providing a return postcard integrally formed with the flapless envelope.

In an embodiment, the method further comprises the steps of providing a delivery notice/receipt form integrally formed with the flapless envelope.

In an embodiment, the method further comprises the step of providing a perforated tear line to provide removal of the delivery notice/receipt from the flapless envelope.

In an embodiment, the method further comprises the step of providing a perforated tear line to assist in removing the return postcard and the at least one form from the flapless envelope.

In an embodiment, the method further comprises the step of providing a removable strip along the width of the mailpiece.

In an embodiment, the method further comprises the step of providing a designator on the envelope indicative of the special services required.

In an embodiment, the method further comprises the step of providing an instruction section to assist in forming the mailpiece.

In another embodiment of the present invention, a combined assembly includes a mailing form and an envelope for mailing an article requiring special services. The assembly comprises: a first sheet; and a second sheet connectable to the first sheet to form an envelope, without a flap, a postcard and a form wherein the postcard and the form are independently removable from the envelope without disrupting the article in the envelope wherein the envelope, the postcard and the form are at most two layers, and a portion of one of the layers of the form is removable from a remainder of the form.

In an embodiment, the combined assembly further includes a form wherein the form is a delivery notice/receipt form.

In an embodiment, the combined assembly further includes a designator on the envelope indicative of the special services required.

In an embodiment, the assembly further includes a removable strip along the width of the envelope.

In an embodiment, the assembly further comprises a two-layer detachable form including a first form constructed of one of the sheets and a second form constructed from the other sheet wherein the two forms are individually separable from the envelope.

It is, therefore, an advantage of the present invention to provide an improved system for mailing an article requiring special service.

Another advantage of the present invention is to provide a simplified method for forming a mailpiece for carrying an article requiring special services.

And, another advantage of the present invention is to provide a system and an assembly that is integrally formed as a complete unit for mailing and labeling of an article requiring special services.

Yet another advantage of the present invention is to provide a system for mailing an article and a method for forming a mailpiece requiring special services without requiring additional adhesives or fixatives for attaching the same to the mailpiece.

Moreover, an advantage of the present invention is to provide a system for mailing an article requiring special services and a method for forming a mailpiece for carrying an article requiring special services that is substantially foolproof.

Still another advantage of the present is to provide a flapless envelope that thus reduces materials needed over present envelope requirements.

Another advantage of the present invention is to provide at least one U.S. Postal Service Form 3849 or any additional system processing type form detachably connected to the flapless envelope. This form has the advantage of also having two different sizes thereby providing that one may be placed on top of the other.

Yet, a further advantage of the present invention is to provide a flapless envelope which will work on automated inserting equipment.

And, another advantage of the present invention is to provide a flapless envelope, a return postcard and at least one other form that all provide for pre-imaging or pre-printing of variable information thereon.

Further, another advantage is provided by the present invention in that large volumes of mail that must be processed with mail inserting equipment are easily accommodated by the present invention.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides an assembly for mailing an article requiring special services. Further, the present invention provides a method for forming a unitary mailpiece having an interior compartment for carrying articles requiring special services.

Figure 1:
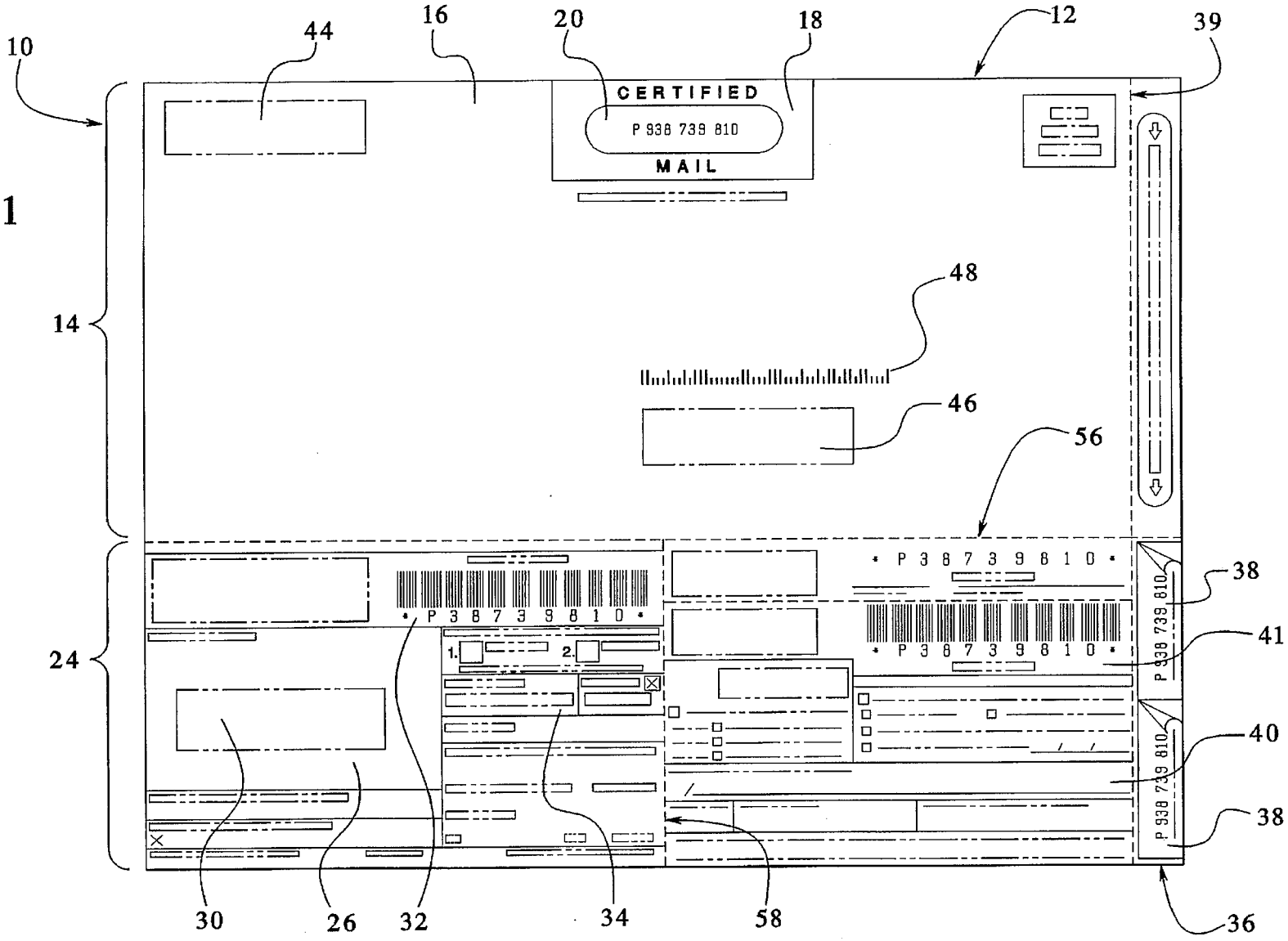
FIG. 1 illustrates a plan view of a front side of an embodiment of an assembly of the present invention.

Referring now to the drawings, wherein like numerals refer to like parts, FIG. 1 generally illustrates an assembly 10 formed from a single sheet 12 folded in a manner to provide both a compartment and a return postcard. The single sheet 12 is folded to form a top layer 1, or first sheet, and a bottom layer 2, or second sheet. The assembly 10, in use, is capable for use in mailing an article within the compartment requiring a special service. Although a certified mail envelope is illustrated, it should be understood that the present invention is applicable to any mailing item requiring special services, such as insured mail, registered mail, COD, return receipt for merchandise and the like.

Figure 7:
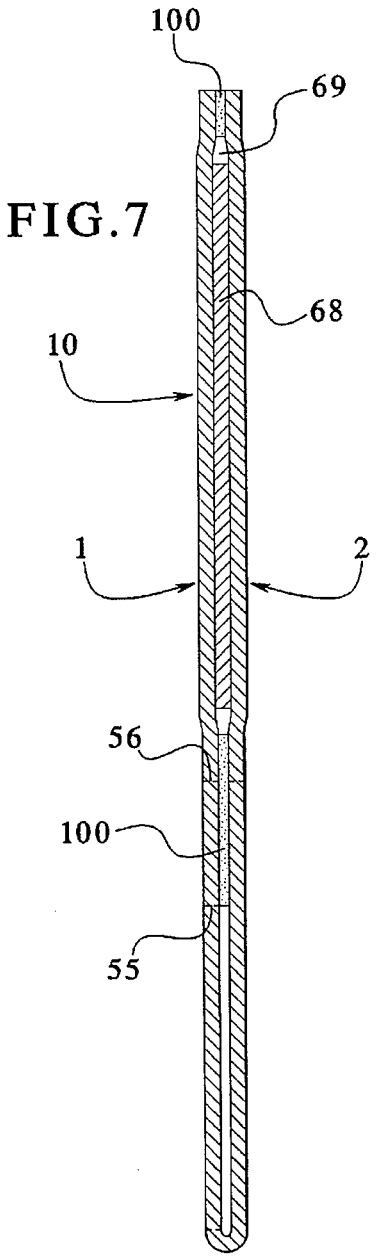
FIG. 7 illustrates a cross-sectional view of adhesively secured areas of an embodiment of an assembly shown in FIG. 1 taken generally along the line VII—VII.
Figure 8:
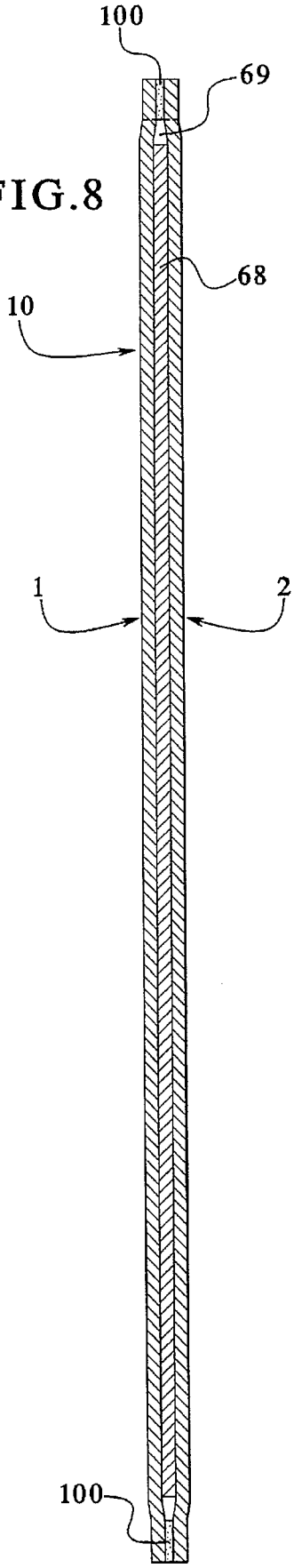
FIG. 8 illustrates a cross-sectional view of adhesively secured areas of an embodiment of an assembly shown in of FIG. 1 taken generally along the line VIII—VIII.
Figure 9:
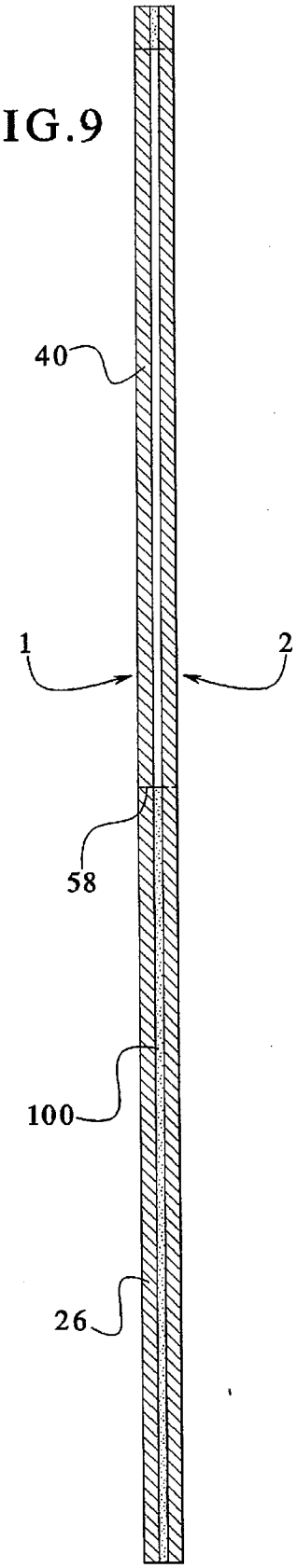
FIG. 9 illustrates a cross-sectional view of adhesively secured areas of an embodiment of an assembly shown in of FIG. 1 taken generally along the line IX—IX.

FIGS. 7–9 illustrate an adhesive layer 100 applied between the top layer 1 and the bottom layer 2 to secure necessary portions of the assembly 10. As shown in FIG. 7, a document 68 is enclosed within an interior compartment 69 formed between the top layer 1 and bottom layer 2 of the assembly 10 in the area shown between two separated adhesive areas 100. FIGS. 8 and 9 also illustrate the adhesive areas 100 necessary to use the assembly 10 as will be described hereinafter.

The front side of the assembly 10 illustrated in FIG. 1 includes a top portion 14 forming a front side of a flapless envelope 16. The top portion 14 of the assembly 10 comprises the flapless envelope 16 and includes, in a preferred embodiment, a pre-printed label 18 indicative of the special service required for mailing of the assembly 10. The label 18 is preferably pre-printed directly on the top portion 14 of the assembly 10.

The pre-printed label 18 includes a window section 20 including an article identification number. The window section 20 has the appearance of a window in that the window section 20 is distinct from a remainder of the label 18. The window section 20, as illustrated, is not an aperture and is, therefore, only visible from a front side of the assembly 10. The pre-printed label 18 is printed separately on both sides of the assembly 10 such that the type of special service required for mailing of the assembly 10 is visible from both a front and a rear side of the top portion 14 as more clearly illustrated in FIG. 2.

The assembly 10 also has a bottom portion 24 that includes a return receipt postcard 26 that can be similar to United States Postal Service form PS-3811. The return receipt postcard 26 may include a set of instructions 28 for the sender, as well as an article addressee section 30 for pre-printing the addressee's address. The return receipt postcard 26 also has a document control number bar code 32 to aid in tracking of the document. The return receipt postcard 26, in a preferred embodiment, is constructed of two pieces of paper laminated together.

In addition, the return receipt postcard 26 has a number of sub-sections requiring completion by the sender prior to mailing the assembly 10 to the addressee at the address on the top portion 14 of the flapless envelope 16. One sub-section illustrated at numeral 34 includes a machine readable article identification number corresponding to the number in the window section 20 of the pre-printed label 18. The sub-section 34 may have a background color that contrasts with the color of the return receipt postcard 26 so as to simplify the reading of the machine-readable code in the sub-section 34. Other sections, as well, may include similar color-contrasting portions within the return receipt postcard 26.

A detachable strip 36 which includes an article tracking label 38 is provided along an end width of the assembly 10 and is removable from the assembly 10 by a perforated tear line 39. The article tracking label 38 may be adhesively backed for subsequent attachment to a receipt or other item requiring designation of the article number for related purposes. As illustrated, two tracking labels 38 are provided in the embodiment shown.

The certified article number tracking label 38 also can be used for the sender's and receiver's record keeping and/or accounting use. The tracking label 38 is preferably perforated from the bottom portion 24 and may be provided with adhesive on its reverse side.

Another substantial section of the bottom portion 24 of the assembly 10 is, in a preferred embodiment, a combined delivery notice/reminder/receipt form 40. This delivery notice/reminder/receipt form 40 is preferably U.S. Postal Service Form PS 3849. In a preferred embodiment, two copies of the delivery notice/reminder/receipt form 40, i.e., Form PS 3849, are provided. A bar code 41 bearing the article number is provided on the first notice 40. The first notice 40 is preferably constructed of a single ply of paper, and a second notice 42 located beneath the first notice 40 (see FIG. 3) is also constructed of single ply paper, a portion of the second notice 42 may also, however, include a portion "(B)" of the top layer labelled in FIGS. 3 and 4. The second notice 42 does not include the bar code 41.

Thus, the bottom half 24 of the assembly 10 includes two main sections: the return receipt postcard 26 and the first and second delivery notices 40, 42. In addition, the tracking labels 38 are provided. As mentioned above, the return receipt postcard 26 has a number of sub-sections requiring completion by the sender prior to mailing the assembly 10.

An advantage of the present invention is that a number of the sub-sections of the return postcard 26, the delivery notice/receipt 40 and the envelope 32 can all be pre-printed when the assembly 10 of the present invention is used.

Referring again to the top portion 14 of the assembly 10, the detachable strip 36 is removable from the assembly 10 by pulling the strip 36 along the perforated tear line 39. By doing so, the addressee is able to open the flapless envelope 16 to expose the contents thereof. In addition, a sender address section 44 and an addressee address section 46 can also be pre-printed when using the assembly 10. Also, a computer bar mailing code 48 may be provided above the addressee address section 46.

Figure 2:
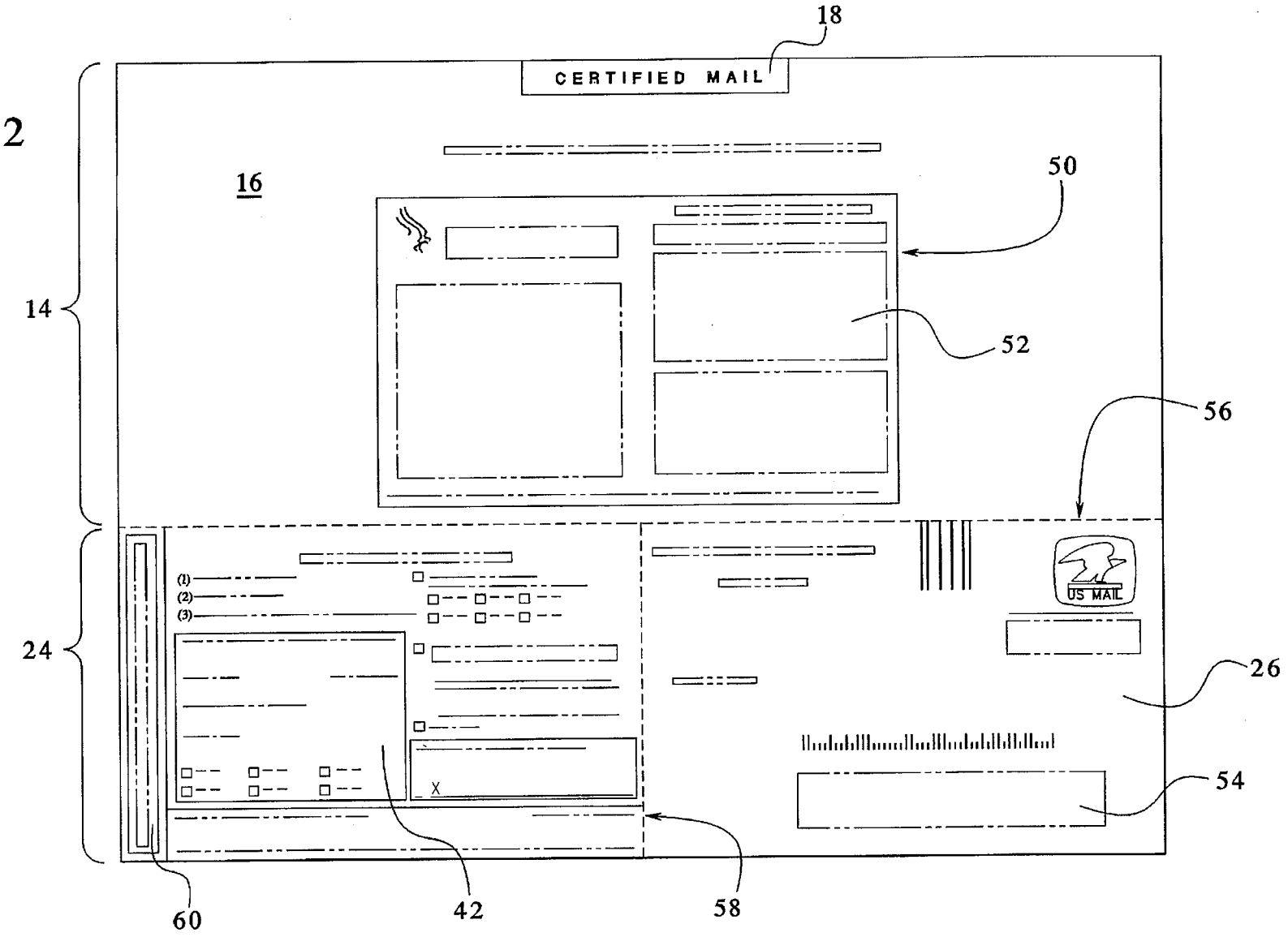
FIG. 2 illustrates a plan view of a back side of an embodiment of the assembly of the present invention.

Referring now to FIG. 2, a back side of the assembly 10 is illustrated. The reverse side of the top portion 14 shown in FIG. 1 is, therefore, illustrated providing a back side of a flapless envelope 16 of the assembly 10.

The top portion 14 of the back side includes an instruction section 50 including instructions generally designated at 52 for completing the forms, such as the return postcard 26, and any additional instructions needed.

The bottom portion 24 of the back side of the assembly 10 includes a front side of the return receipt postcard 26. The return receipt postcard 26 includes a "Return To" section 54. The "Return To" section 54 may be color-contrasted with the remainder of the return receipt postcard 26 to enable simplified reading of the "Return To" section 54. A perforated tear line 56 is provided along the top side of the return receipt postcard 26. The return receipt postcard 26 also has a perforated tear line 58 along the edges adjacent to the delivery notices 40, 42. The bottom portion 24 may also include instructions with respect to the purpose of the article tracking labels 38 on the reverse side thereof.

Figure 3:
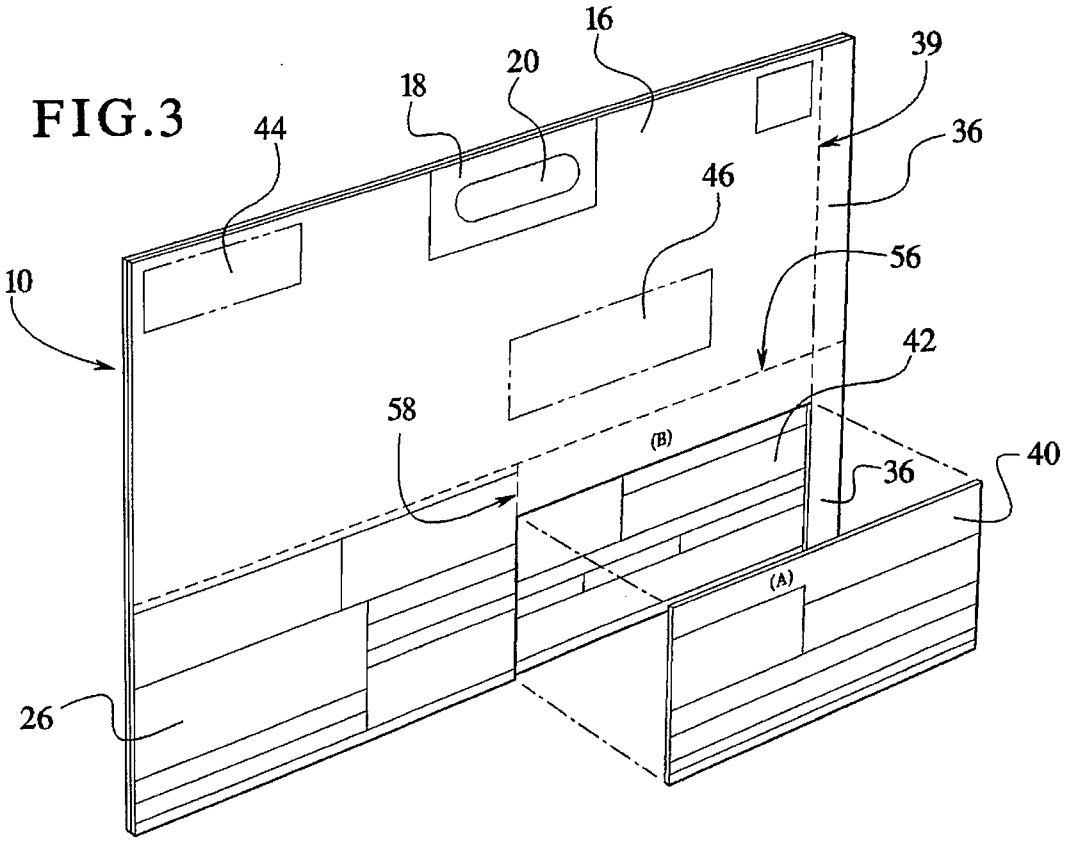
FIG. 3 illustrates a perspective view of a front side of an embodiment of the assembly of the present invention with a portion thereof detached.

Referring to FIGS. 3–6, a completed flapless envelope assembly 10, shown from its front side, is illustrated in FIG. 3. The pre-printed label 18 is shown having a window section 20 in which a certified mail number may be printed either manually or automatically. FIG. 3 also illustrates the detachment of the delivery notice 40 from the assembly 10 at a perforated tear line 55 and the perforated line 58 as shown prior to removal or detachment in FIG. 1. The first delivery notice 40 is thus independently separable from the assembly 10 and the second delivery notice 42.

Figure 4:
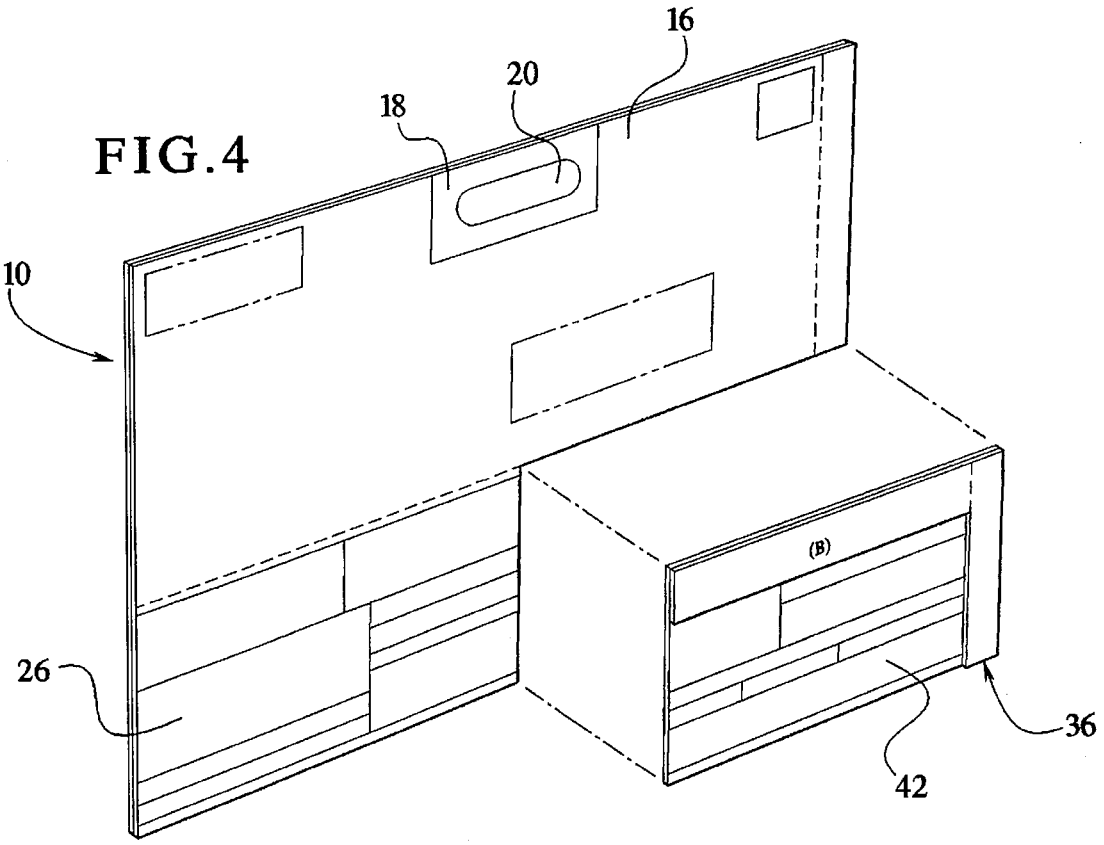
FIG. 4 illustrates a perspective view of a front side of an embodiment of the assembly of the present invention with another portion thereof detached.

FIG. 4 illustrates the detachment of the second delivery notice 42 from the assembly 10. The second delivery notice 42 is separated from the flapless envelope 16 along the perforated tear line 56 and the perforated tear line 58. In this manner, the postal employee is able to leave at least two delivery notices 40, 42. Thus, it is possible for the postal employee to attempt at least two special service deliveries which may prove to be unsuccessful. However, the potential recipient addressee will receive at least two delivery notices 40, 42 indicating that the attempts were made. The second notice 42 includes the section designated "B" after removal of the delivery notice 40. The section designated "B" provides an identifier for the assembly 10 after removal of the delivery notice 40. As a result, the section B provides identification of the assembly 10 that is unique to the assembly 10 and corresponds to the other identifiers on the assembly 10.

Figure 5:
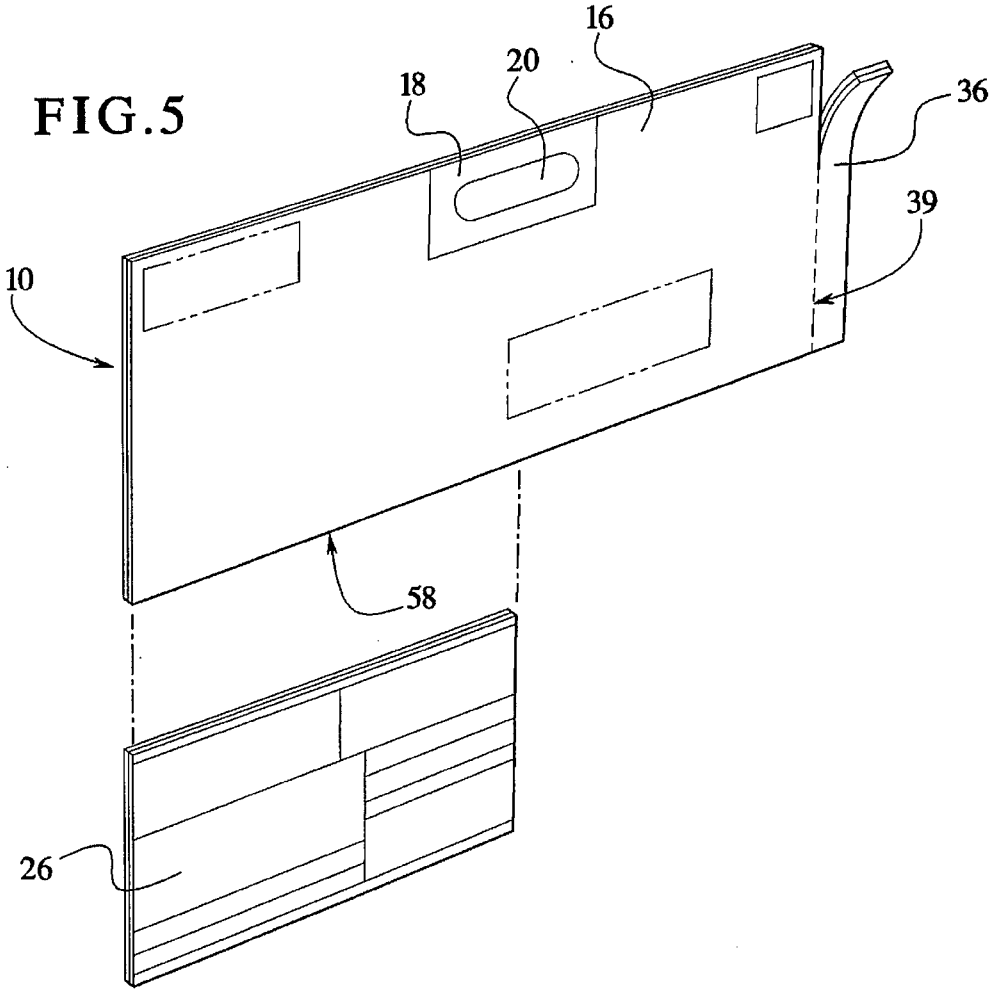
FIG. 5 illustrates a perspective view of a front side of an embodiment of the assembly of the present invention with a further portion thereof detached.

FIG. 5 illustrates the removal of the return receipt postcard 26 from the flapless envelope 16 of the assembly 10 by tearing at the perforated tear line 56. Note that the delivery notices 40, 42 have already been removed from the assembly 10.

As illustrated in FIG. 5, the detachable strip 36 is shown partially torn away from the flapless envelope 16 of the assembly 10. The detachable strip 36 separates along the perforated tear line 39. This is done to gain access to the contents of the flapless envelope 16. As shown, this is a simple operation and, thus, is quite convenient for the addressee.

Figure 6:
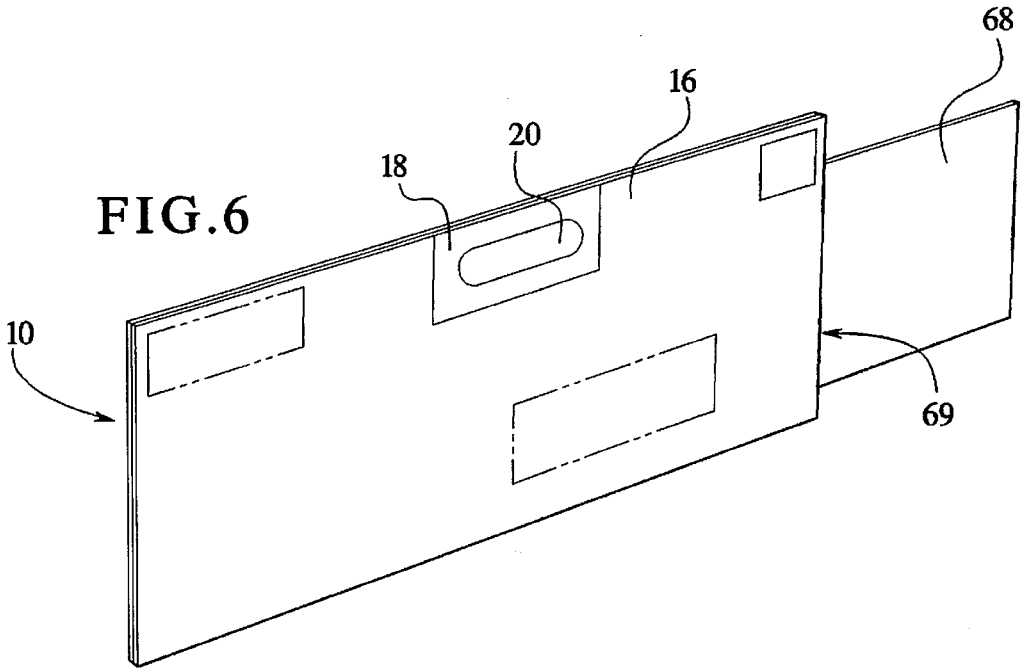
FIG. 6 illustrates a perspective view of a front side of an embodiment of the assembly of the present invention with a document contained therein partially exposed.

FIG. 6 illustrates a document 68 partially removed from an interior compartment 69 of the flapless envelope 16 of the assembly 10. As mentioned above, the contents of the flapless envelope become accessible by removing the detachable strip 36.

As an added advantage of the present invention, the delivery notice/reminder/receipt 40 located at the bottom portion 24 of the assembly 10 is of course removable and, thus, can also serve as a postal receipt. That is, the section includes the corresponding bar-coded article number 41 and a signature and date line wherein the receiver, preferably the addressee, may sign on the line and date the same. Then, the postal employee or other designated sender may retain the sub-section within its records indicating the article number and the date on which the assembly 10 was received as attested to by the signature of the receiver.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A system for mailing an article requiring special services, the system comprising:

an envelope having an interior compartment formed by a first sheet and a second sheet wherein a first portion of the first sheet and the second sheet is adhesively sealed around their peripheral edges to form the interior compartment and further wherein a second portion of the first sheet and the second sheet extends beyond one of the sealed sides of the first portion to form both a return postcard and at least one form wherein each of the return postcard and the at least one form is integrally formed with and adjacently attached directly to the envelope and is independently detachable from the envelope.

2. The system of claim 1 wherein the at least one form is a delivery notice/receipt form integrally formed with the sheets forming the envelope and wherein the delivery notice/receipt form is individually, selectively detachable from the envelope.

3. The system of claim 1 further comprising:

a first perforated tear line that separates the envelope from the postcard and the at least one form and a second perforated tear line that separates the postcard from the at least one form wherein the first and second perforated tear lines are constructed and arranged to provide independent removal of the return postcard or the at least one form from the envelope.

4. The system of claim 1 further comprising:

a perforated tear line formed between the return postcard and the at least one form, the perforated tear line constructed and arranged to provide independent removal of the return postcard and the at least one form.

5. The system of claim 1 further comprising:

a removable section adjacent the first and second portions of the sheets.

6. The system of claim 1 further comprising:

a designator on the envelope indicative of the special service required.

7. A method for forming a unitary mailpiece having an interior compartment for carrying an article requiring special services, the method comprising the steps of:

providing a sheet;

folding the sheet to form two layers wherein a first layer is substantially equal in size to a second layer;

sealing a first portion of the first layer and the second layer around their peripheral edges to form an envelope having an interior compartment formed between the first layer and the second layer and further wherein a second portion of the first layer and the second layer creates at least one form integrally formed with and adjacently attached directly to the first portion and still further wherein a third portion of the first layer and the second layer forms a return postcard integrally formed with and adjacently attached directly to the first portion.

8. The method of claim 7 wherein the at least one form is a delivery notice/receipt form.

9. The method of claim 7 further comprising the step of:

providing a perforated tear line to selectively remove the at least one form from the first portion.

10. The method of claim 7 further comprising the step of:

providing a perforated tear line to selectively remove the return postcard and the at least one form from the first portion.

11. The method of claim 7 further comprising the step of:

providing a removable strip along one of the sides of the first portion.

12. The method of claim 7 further comprising the step of:

providing a designator on the first portion indicative of the special services required.

13. A combined assembly including a mailing form and an envelope for mailing an article requiring special services, the assembly comprising:

a first sheet; and a second sheet connected to the first sheet to form a postcard, a form and an envelope without a flap; and a first perforated tear line that separates the envelope from the postcard and the form and a second perforated tear line between the form and the postcard wherein the first and second perforated tear lines provide for selective removal of the postcard and the form from the envelope wherein the form includes two layers with one layer removable from the other layer.

14. The combined assembly of claim 3 wherein the form is a delivery notice/receipt form.

15. The combined assembly of claim 13 further comprising:

a designator on the envelope indicative of the special services required.

16. The combined assembly of claim 13 further comprising:

a removable strip along one side of the envelope.

17. A system for mailing an article requiring special services, the system comprising:

an envelope having an interior compartment formed by a first sheet and a second sheet wherein a first portion of the first sheet and the second sheet is adhesively sealed along three peripheral sides of the first portion to form the interior compartment and further wherein a second portion of the first sheet and the second sheet extends beyond one of the sealed sides of the first portion to form both a return postcard and at least one form wherein the return postcard and the at least one form are integrally formed with the envelope and are independently detachable from the envelope; and at least one identifier section having an identifier related to the article requiring special services removably attached to the second portion of the first sheet and the second sheet.

18. A system for mailing an article requiring special services, the system comprising:

an envelope having an interior compartment formed by a first sheet and a second sheet wherein a first portion of the first sheet and the second sheet is adhesively sealed along three peripheral sides of the first portion to form the interior compartment and further wherein a second portion of the first sheet and the second sheet extends beyond one of the sealed sides of the first portion to form both a return postcard and at least one form wherein the return postcard and the at least one form are integrally formed with the envelope and are independently detachable from the envelope wherein the at least one form is constructed and arranged such that the first layer of the at least one form forms a first form and the second layer of the at least one form forms a second form, the first form individually detachable from the envelope independently of the second form by perforated tear lines between the first form, the second form and the flapless envelope.

* * * * *